US006306187B1

(12) United States Patent
Maeda et al.

(10) Patent No.: US 6,306,187 B1
(45) Date of Patent: Oct. 23, 2001

(54) ABRASIVE MATERIAL FOR THE NEEDLE POINT OF A PROBE CARD

(75) Inventors: Toshiro Maeda, Fukuoka; Naoya Kamata, Isehara; Kazuo Tanaka; Reiji Yoshizumi, both of Kumamoto, all of (JP)

(73) Assignees: 3M Innovative Properties Company, St. Paul, MN (US); NEC Corporation, Tokyo (JP)

( * ) Notice: Subject to any disclaimer, the term of this patent is extended or adjusted under 35 U.S.C. 154(b) by 0 days.

(21) Appl. No.: 09/402,503

(22) PCT Filed: Apr. 16, 1998

(86) PCT No.: PCT/US98/07722

§ 371 Date: Oct. 5, 1999

§ 102(e) Date: Oct. 5, 1999

(87) PCT Pub. No.: WO98/47663

PCT Pub. Date: Oct. 29, 1998

(30) Foreign Application Priority Data

Apr. 22, 1997 (JP) ..... 9-104193

(51) Int. Cl.[7] ..... B24D 15/04; B24D 11/00; B24D 3/32

(52) U.S. Cl. ..... 51/298; 51/295; 51/307; 51/309; 451/533

(58) Field of Search ..... 51/298, 295, 307, 51/309; 451/533; 134/6; 15/218.1, 244.1

(56) References Cited

U.S. PATENT DOCUMENTS

| | | | | |
|---|---|---|---|---|
| 3,982,357 | * | 9/1976 | Eldridge et al. | 51/293 |
| 4,714,644 | * | 12/1987 | Rich | 428/136 |
| 5,016,401 | * | 5/1991 | Mangus | 51/293 |
| 5,134,809 | * | 8/1992 | Morton et al. | 51/293 |
| 5,429,545 | * | 7/1995 | Meyer | 51/293 |
| 5,609,513 | * | 3/1997 | Stark | 451/59 |
| 5,962,120 | * | 10/1999 | Keipert | 428/317.9 |

FOREIGN PATENT DOCUMENTS

| | | |
|---|---|---|
| 61-004969 | 1/1986 | (JP) . |
| 61-152034 | 7/1986 | (JP) . |
| 62-211928 | 9/1987 | (JP) . |
| 62-256009 | 11/1987 | (JP) . |
| 63-002657 | 1/1988 | (JP) . |
| 63-170933 | 7/1988 | (JP) . |
| 01-055835 | 3/1989 | (JP) . |
| 01-282829 | 11/1989 | (JP) . |
| 02-002939 | 1/1990 | (JP) . |
| 03-010176 | 1/1991 | (JP) . |
| 03-076242 | 4/1991 | (JP) . |
| 03-105940 | 5/1991 | (JP) . |
| 04-096342 | 3/1992 | (JP) . |
| 04-177849 | 6/1992 | (JP) . |
| 5-166893 | 7/1993 | (JP) . |
| 5-209896 | 8/1993 | (JP) . |
| 07-170235 | 7/1995 | (JP) . |
| 7-199141 | 8/1995 | (JP) . |
| 7-244074 | 9/1995 | (JP) . |
| 08-220334 | 8/1996 | (JP) . |

* cited by examiner

*Primary Examiner*—Michael Marcheschi
(74) *Attorney, Agent, or Firm*—Mueting, Raasch & Gebhardt, PA

(57) ABSTRACT

An abrasive material for the needle point of a probe card which can effectively remove foreign matter adhering to the needle point of the probe, protect the needle point from damage and deformation, and prolong the life of the probe. The abrasive material for the needle point of a probe card comprises an abrasive layer including a layer of micropowdered abrasive grains applied to a substrate and a cushion layer having a buffer action and elasticity.

6 Claims, 1 Drawing Sheet

ABRASIVE MATERIAL FOR THE NEEDLE POINT OF A PROBE CARD

BACKGROUND OF THE INVENTION

1. Field of the Invention

The present invention generally relates to an abrasive material for cleaning the needle point of a probe card and particularly relates to an abrasive material, which is capable of removing foreign matter adhering to the needle point of the probe card that is used to measure the electrical characteristics of a semiconductor chip formed on a semiconductor wafer.

2. Description of the Background Art

The probe of a probe card for measuring the electrical characteristics of a semiconductor chip formed on a semiconductor wafer is pressed against and contacted with the pad of the semiconductor chip. At this time, aluminum powder scraped from the pad of the semiconductor chip adheres to the tip (needle point) of the probe. If the aluminum powder is not removed from the needle point, aluminum remaining on the needle point is oxidized to aluminum oxide, allowing the resistance between the probe and the pad to be increased. Because the electrical contact is impaired, a continuity defect occurs so that the electrical characteristics cannot be exactly determined. For this, there are methods by which the needle point is cleaned every prescribed number of probes to remove the aluminum powder. The following methods are used to remove the aluminum powder.

(1) Methods using a grinding stone (see Japanese Patent Applications Laid-open No. 209896/1993, No. 96342/1992, and No. 2657/1988, and Japanese Utility Model Application No. 11167/1992).

(2) Methods using a sanding plate (see Japanese Patent Applications Laid-open No. 166893/1993, No. 177849/1992, No. 105940/1991, No. 10176/1991, and No. 152034/1986, and Japanese Utility Model Application No. 26772/1995).

(3) Methods using a ceramic plate (see Japanese Patent Applications Laid-open No. 4969/1986 and No. 282829/1989, Japanese Utility Model Application No. 55338/1986, Japanese Patent Applications Laid-open No. 2939/1990, No. 55835/1989, and No. 170933/1988).

(4) A method using abrasive grains (Japanese Utility Model Application No. 97840/1986).

(5) A method using a frosted glass (see Japanese Patent Application Laid-open No. 199141/1995).

(6) A method using a glass coating (see Japanese Patent Application Laid-open No. 76242/1991).

In these methods, the needle point is pressed against the pad in the same manner as in the probing operation to remove the aluminum powder.

However, there are the following problems in these methods.

(1) The needle point breaks.

(2) Aluminum powder adhering in clearance gaps cannot be removed because the intervals between the concave and convex parts of the surface of the ceramic plate are in the range of 1–12 $\mu$m, while those of the needle point (contact surface) are 0.35 $\mu$m approximately.

(3) The needle point is worn down so that the life of the probe is short.

(4) The shape of the needle point tends to be deformed under the same load (about 2.5 kgf) as in the probing operation.

Also, a method using a cleaning material in which micro-powdered abrasives are compounded in a base material is disclosed (see Japanese Patent Application Laid-open No. 244074/1995).

In this method, the cleaning material can prolong the life of the probe.

However, the above problems (1), (2), and (4) cannot be solved by the use of the cleaning material.

The present invention has been achieved in view of this situation and has an object of providing an abrasive material for the needle point of a probe card which is capable of effectively removing foreign matter adhering to the needle point of the probe, of avoiding damage to and deformation of the needle point, and of prolonging the life of the probe.

SUMMARY OF THE INVENTION

The above object can be attained in the present invention by the provision of an abrasive material for the needle point of a probe card comprising:

an abrasive layer including a layer of micro-powdered abrasive grains applied to a substrate, and a cushion layer having a buffer action and elasticity.

In preferred embodiments of the present invention, the surface of the abrasive layer contacting the needle point of the probe card has an irregular pattern corresponding to the pattern of the needle point of the probe card; and the cushion layer consists of a modacrylic resin.

DETAILED DESCRIPTION OF THE INVENTION AND PREFERRED EMBODIMENT

The present invention will be explained in detail by way of an embodiment of the present invention with reference to the drawings.

Figure 1:
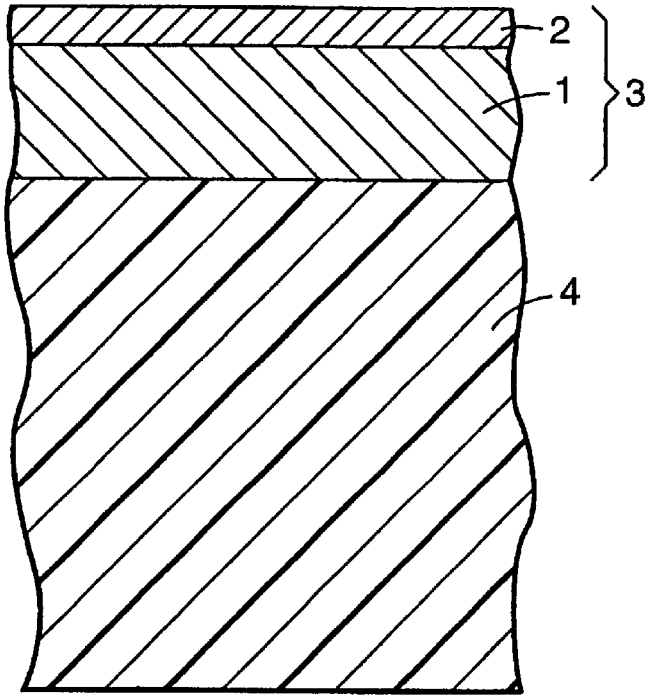
FIG. 1 is a schematic sectional view of an embodiment of the abrasive material for the needle point of a probe card of the present invention.
Figure 2:
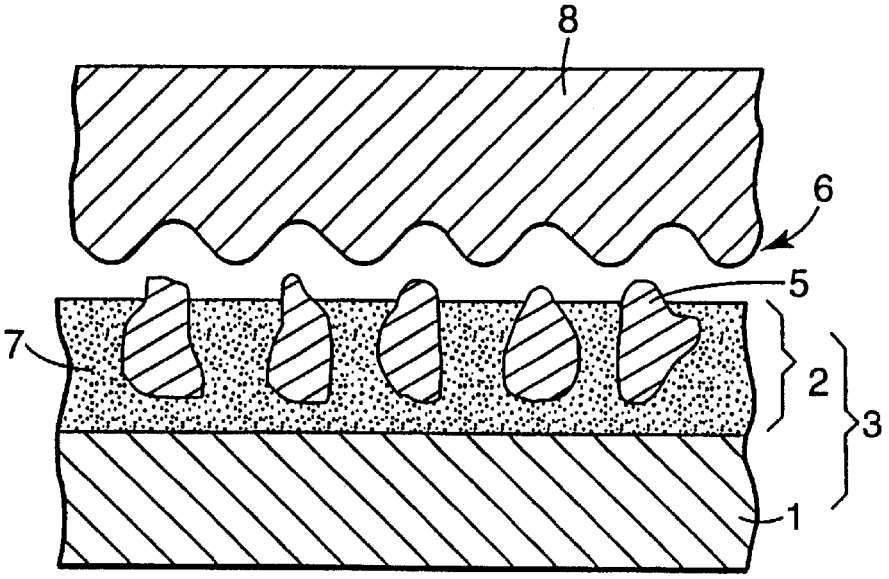
FIG. 2 is a schematic sectional view showing the relation between the shape of the abrasive layer and the shape of the needle point of the probe card in the present invention.

As shown in FIGS. 1 and 2, the abrasive material for the needle point of a probe card in the present invention includes an abrasive layer 3 provided with micro-powdered abrasive grains 5 arranged on a substrate 1, and a cushion layer 4 having a buffer action and elasticity.

Abrasive Layer

The abrasive layer 3 used in the present invention includes an abrasive grain layer 2 applied to the substrate 1.

Substrate

It is desirable that the substrate 1 give a specific stiffness to the abrasive grain layer 2 because the abrasive material of the present invention is mounted on a specific machine together with the probe card and is automatically moved, mounted, and dismounted. Specifically, given as materials for the substrate 1 are polyethylene terephthalate (PET), polyethylene naphthalate, vinyl chloride, polypropylene, and pulp cloth.

It is desirable that the thickness of the substrate 1 be, for example, in a range of from 12 to 250 $\mu$m although there are no limitations to the thickness.

Abrasive Grain Layer The abrasive grain layer 2 includes abrasive grains 5 within a resin 7 (e.g., a polyester resin). As the abrasive grains 5 used in the abrasive grain layer 2, it is preferable to select and arrange grains having such an average particle diameter that the shape of the needle point is in accord with the irregular shape of the needle 6, which is part of needle substrate 8, to promote lapping and cleaning efficiencies. It is preferable to use grains having an average particle diameter of the same or smaller magnitude as the intervals between the concave part and convex part (hereinafter called "irregular intervals") of the needle point 6. When using a needle point 6 having irregular intervals of 0.35 μm, the surface roughness (Sm) of the abrasive layer is preferably less than 0.35 μm. Also, it is desirable that the average particle diameter of the abrasive grains 5 be 0.5 μm–3 μm.

By this structure, as shown in FIG. 2, the tip of the abrasive grains 5 can be inserted into the convex part of the needle point in accordance with the irregularity of the needle point to effectively remove foreign matter.

The following materials may be used for the abrasive grain layer 2 though there are no limitations to the materials: alumina, silicon carbide, chromium oxides, CBN, diamond powder, cerium oxide, silicon oxide ($SiO_2$), and zirconium oxide ($Zr_2O_3$).

Though there are no limitations to the application of the abrasive grain layer 2 on the substrate 1, for example, slurry coatings such as a gravure coating, knife coating, and the like, electrostatic coatings, drop coatings, and the like may be used. It is desirable to arrange the density distribution of the abrasive grains in the abrasive grain layer 2 according to the average particle diameter of the abrasive grains so that the surface shape of the abrasive layer 3 corresponds with the irregular shape of the needle point 6.

The thickness of the substrate 1 is preferably in a range of from 15 to 300 μm. If the thickness is less than 15 μm, the strength of the abrasive layer 3 is so reduced that the abrasive layer 3 tends to be broken. Also, if the thickness exceeds 300 μm, the handling characteristics are impaired.

Cushion Layer

For the cushion layer 4 used in the present invention, elasticity and buffer action are required to avoid damage to and deformation of the needle point when the abrasive layer 3 contacts the needle point 6, and to prolong the life of the probe.

The following material characteristics are required for the cushion layer 4. For example, the preferable bending elastic modulus is in a range of from $1.2\times10^3$ to $9.0\times10^3$ kg/cm$^2$ when using foamed materials as the cushion layer, and the preferable shore hardness A is in a range of from 30 to 90 when rising rubbers or modacrylic materials as the cushion layer.

Specific examples of materials for the cushion layer 4 are acrylic resins, synthetic rubbers, and foamed materials.

By this construction, forced pressure (load by pressure) between the cushion layer 4 and the needle point 6 can be in a range of from 0.3 to 0.5 kg/cm$^2$. The thickness is preferably in the range of 300 μm to 500 μm. If less than 300 μm, the load by pressure becomes overloaded, and if more than 500 μm, it becomes difficult to handle the cushion layer itself.

Though there are no limitations to the method for laminating the abrasive layer 3 to the cushion layer 4, a method using a pressure sensitive adhesive or bond, e.g., hotmelt, may be used.

The abrasive material of the present invention has a two-layer structure consisting of the abrasive layer 3 and the cushion layer 4. Therefore, the abrasive material of the present invention possesses appropriate stiffness, elasticity, and buffer action. Also, the present invention can effectively provide desirable abrasive materials by independently providing the abrasive layer 3 and the cushion layer 4 and combining them according to the characteristics or specifications required for the probe card.

EXAMPLES

The present invention will be explained in more detail by way of examples, which are not intended to be limiting of the present invention.

Provided as the abrasive layer was a superfine film abrasive (Imperial Lapping Films™ (aluminum oxide 1 mil 1 μm type DH) manufactured by Sumitomo 3M Ltd.), which was produced by compounding abrasive grains consisting of aluminum oxide with an average diameter of 0.1 μm with a polyester resin in a ratio of 4:1 and applying the resulting mixed material to a polyethylene terephthalate film with a thickness of 24 μm by a slurry coating. Also, provided as the cushion layer was a structural bonding tape with a thickness of 1.0 mm (VHB Y-4910J™, manufactured by Sumitomo 3M Ltd.) which contained an acrylic resin as a major component and had an appropriate stickiness and a shore hardness of 50. The superfine film abrasive and the structural bonding tape were laminated and pressed to prepare the abrasive material of the present invention.

Using this abrasive material, the needle point of a probe was lapped and cleaned. As a result, the intervals between the concave and convex portions of the abrasive layer were reduced to less than 0.35 μm and the pressure load could be reduced to about 0.3 kgf.

By using this abrasive material for lapping and cleaning the needle point of the probe card, it was possible to lap and clean the needle point without deformation of the shape of the needle point, to reduce the wear of the needle point, to prolong the life of the probe, and to reduce the contact resistance.

As shown by the above explanations, the present invention can provide an abrasive material for the needle point of a probe card which can effectively remove foreign matter adhering to the needle point of the probe, efficiently protect the needle point from damage and deformation, and prolong the life of the probe.

What is claimed is:

1. An abrasive material for a needle point of a probe card comprising:

an abrasive layer comprising an abrasive grain layer, which includes a layer of micro-powdered abrasive grains arranged at irregular intervals, applied to a substrate; and a cushion layer having a buffer action and elasticity, wherein the cushion layer is applied to the substrate of the abrasive layer.

2. The abrasive material for the needle point of a probe card according to claim 1, wherein the surface of the abrasive layer contacting the needle point of the probe card has an irregular pattern corresponding to the pattern of the needle point of the probe card.

3. The abrasive material for the needle point of a probe card according to claim 1, wherein the cushion layer consists of a modacrylic resin.

4. An abrasive material for a needle point of a probe card comprising:

an abrasive layer including a layer of micro-powdered abrasive grains applied to a substrate, wherein the surface of the abrasive layer contacting the needle point of the probe card has an irregular pattern corresponding to the pattern of the needle point of the probe card; and a cushion layer having a buffer action and elasticity, wherein the cushion layer is applied to the substrate of the abrasive layer.

5. An abrasive material for a needle point of a probe card comprising:

an abrasive layer comprising an abrasive grain layer, which includes a layer of micro-powdered abrasive grains arranged at irregular intervals, applied to a surface of a substrate; and a cushion layer having a buffer action and elasticity, wherein the cushion layer is applied to the substrate of the abrasive layer;

wherein the abrasive material reduces the wear of the needle point relative to an abrasive material having micro-powdered abrasive grains arranged at more regular intervals when used under the same conditions.

6. An abrasive material for a needle point of a probe card comprising:

an abrasive layer comprising an abrasive grain layer, which includes a layer of micro-powdered abrasive grains arranged at irregular intervals, applied to a surface of a substrate; and a cushion layer having a buffer action and elasticity, wherein the cushion layer is applied to the substrate of the abrasive layer;

wherein the abrasive material prolongs the life of the probe card relative to an abrasive material having micro-powdered abrasive grains arranged at more regular intervals when used under the same conditions.

* * * * *

UNITED STATES PATENT AND TRADEMARK OFFICE

CERTIFICATE OF CORRECTION

PATENT NO. : 6,306,187 B1
DATED : October 23, 2001
INVENTOR(S) : Maeda, Toshiro

It is certified that error appears in the above-identified patent and that said Letters Patent is hereby corrected as shown below:

Title page,
ABSTRACT,
Line 6, delete "micropowdered" and insert in place thereof -- micro-powdered --.

Column 2,
Line 64, insert -- ¶ -- preceding "The"

Column 4,
Line 9, delete "Films$^{Tm}$" and insert in place thereof -- Film$^{TM}$ --.

Signed and Sealed this

Twenty-eighth Day of May, 2002

*Attest:*

*Attesting Officer*

JAMES E. ROGAN
*Director of the United States Patent and Trademark Office*